US008726413B2

(12) United States Patent
Khuong et al.

(10) Patent No.: US 8,726,413 B2
(45) Date of Patent: May 20, 2014

(54) WRIST GUARD

(75) Inventors: Steven Khuong, El Cerrito, CA (US); Mayachela Garcia, El Cerrito, CA (US); Jessica Molly DiBiase, Orinda, CA (US)

(73) Assignee: Majestev, Inc., Richmond, CA (US)

( * ) Notice: Subject to any disclaimer, the term of this patent is extended or adjusted under 35 U.S.C. 154(b) by 406 days.

(21) Appl. No.: 13/010,380

(22) Filed: Jan. 20, 2011

(65) Prior Publication Data

US 2011/0179542 A1 Jul. 28, 2011

Related U.S. Application Data

(60) Provisional application No. 61/298,478, filed on Jan. 26, 2010.

(51) Int. Cl.
*A41D 13/08* (2006.01)
*A41D 19/015* (2006.01)

(52) U.S. Cl.
CPC ..... *A41D 3/088* (2013.01); *A41D 19/01582* (2013.01); *A41D 19/01588* (2013.01)
USPC ..... 2/16; 2/162; 2/166; 128/878

(58) Field of Classification Search
CPC ..... A41D 13/088; A41D 19/01582; A41D 19/01588
USPC ..... 2/16, 160, 22, 24, 20, 166, 162; 128/878
See application file for complete search history.

(56) References Cited

U.S. PATENT DOCUMENTS

| | | | | | |
|---|---|---|---|---|---|
| 1,225,354 | A * | 5/1917 | Pierce | 2/239 |
| 3,533,106 | A * | 10/1970 | Kremp | 2/22 |
| 3,804,084 | A * | 4/1974 | Lehman | 602/26 |
| 4,064,874 | A * | 12/1977 | Valin | 602/26 |
| 4,445,505 | A * | 5/1984 | Labour et al. | 602/26 |
| 4,707,861 | A * | 11/1987 | Lavoie et al. | 2/16 |
| 4,756,026 | A * | 7/1988 | Pierce, Jr. | 2/16 |
| 5,113,526 | A * | 5/1992 | Wang et al. | 2/2.5 |
| 5,938,630 | A * | 8/1999 | Yen | 602/23 |
| 5,943,695 | A * | 8/1999 | Yen | 2/22 |
| 5,983,391 | A * | 11/1999 | Palmer et al. | 2/16 |
| 6,244,997 | B1 * | 6/2001 | Cook | 482/105 |
| 6,773,411 | B1 * | 8/2004 | Alvarez | 602/27 |
| 7,182,088 | B2 * | 2/2007 | Jenkins | 128/878 |
| 39,873 | A1 * | 1/2009 | Hinebaugh | 2/16 |
| 2004/0244090 | A1 * | 12/2004 | Langer | 2/160 |
| 2009/0094730 | A1 * | 4/2009 | Cheng | 2/161.2 |

OTHER PUBLICATIONS

Eagle FCR icewharehouse.com.*
Disclosure Document for Eagle FCR Wrist Guard.

* cited by examiner

*Primary Examiner* — Khoa Huynh
*Assistant Examiner* — Khaled Annis
(74) *Attorney, Agent, or Firm* — Morrison & Foerster LLP

(57) ABSTRACT

A band is described for providing support and/or protection to the wearer. In one embodiment, the band is a wrist band having pockets for several longitudinal reinforcement elements. Thus, for example, a wrist band may be formed from an elastic material had be stitched to form pockets. In one embodiment, the pockets are closed, and the band is provided with a given amount of protection or support. In yet another embodiment, one or more pockets have an opening, which allows a user to adjust the amount of protection and/or support in each pocket.

26 Claims, 5 Drawing Sheets

WRIST GUARD

CROSS-REFERENCE TO RELATED APPLICATIONS

This application claims the benefit of U.S. Provisional Application No. 61/298,478, filed Jan. 26, 2010, the entire contents of which are hereby incorporated by reference herein and made part of this specification.

BACKGROUND OF THE INVENTION

1. Field of the Invention

The present invention generally relates to an elastic garment, and more particularly to a reinforced elastic wrist guard.

2. Discussion of the Background

Many people inflict damage to their bodies while exercising, either due to impact or by straining muscles or joints.

When exercising using kettlebells, for example, stress is placed on the wrist from movement of the kettlebell and from the impact of the kettlebell on the wrist and forearm.

There is a need for a device to protect the wrist and forearm from the stress of movement and impact during exercising. Such a garment should be lightweight, easy to use, and should provide flexibility for the user's wrist.

BRIEF SUMMARY OF THE INVENTION

The present invention overcomes the disadvantages of prior art by providing an elastic band having a user-adjustable reinforcement. Such a structure provides impact protection for the wearer and may also provide support.

In one embodiment, a garment is provided for a portion of the body, such as the wrist. The garment includes an elastic band capable of containing one or more longitudinal reinforcing elements.

In another embodiment, the elastic band includes openings such that a user may adjust the amount of reinforcement in the band.

In certain embodiments, a wrist guard is provided comprising a tube including a fabric, where the tube has a longitudinal axis. one or more pockets extending along the tube; where at least one of the one or more pockets has an opening, and one or more inserts each adapted to removably fit through an opening into one of the one or more pockets. The inserts provide longitudinal stiffness to the tube.

In certain other embodiments, a wrist guard is provided comprising a tube including an elastic fabric, where the tube has a longitudinal axis, eight pockets extending along the tube; where at least one of the eight pockets has an opening, and one or more bendable inserts each adapted to removably fit through an opening into the at least one of the eight pockets. The inserts provide longitudinal stiffness to the tube.

In yet other certain embodiments, a wrist guard for accepting one or more inserts is provided. The comprises a tube including a fabric, where the tube has a longitudinal axis, and one or more pockets extending substantially longitudinally along the tube, where at least one of the one or more pockets has an opening to removably accept at least one of the one or more inserts. The inserts provide longitudinal stiffness to the tube.

In certain embodiments, a wrist guard is provided having a closed pocket that contains at least one of insert.

In certain other embodiments, a wrist guard is provided having 6 pockets, 7 pockets, or 8 pockets.

In yet certain other embodiments, a wrist guard is provided using an elastic fabric.

In certain embodiments, a wrist guard is provided, having a length of 2.5 inches to 6 inches.

In certain other embodiments, a wrist guard is provided including inserts that include includes a bendable plastic or metal.

These features together with the various ancillary provisions and features which will become apparent to those skilled in the art from the following detailed description, are attained by the garment of the present invention, preferred embodiments thereof being shown with reference to the accompanying drawings, by way of example only, wherein:

Reference symbols are used in the Figures to indicate certain components, aspects or features shown therein, with reference symbols common to more than one Figure indicating like components, aspects or features shown therein.

DETAILED DESCRIPTION OF THE INVENTION

Figure 1:
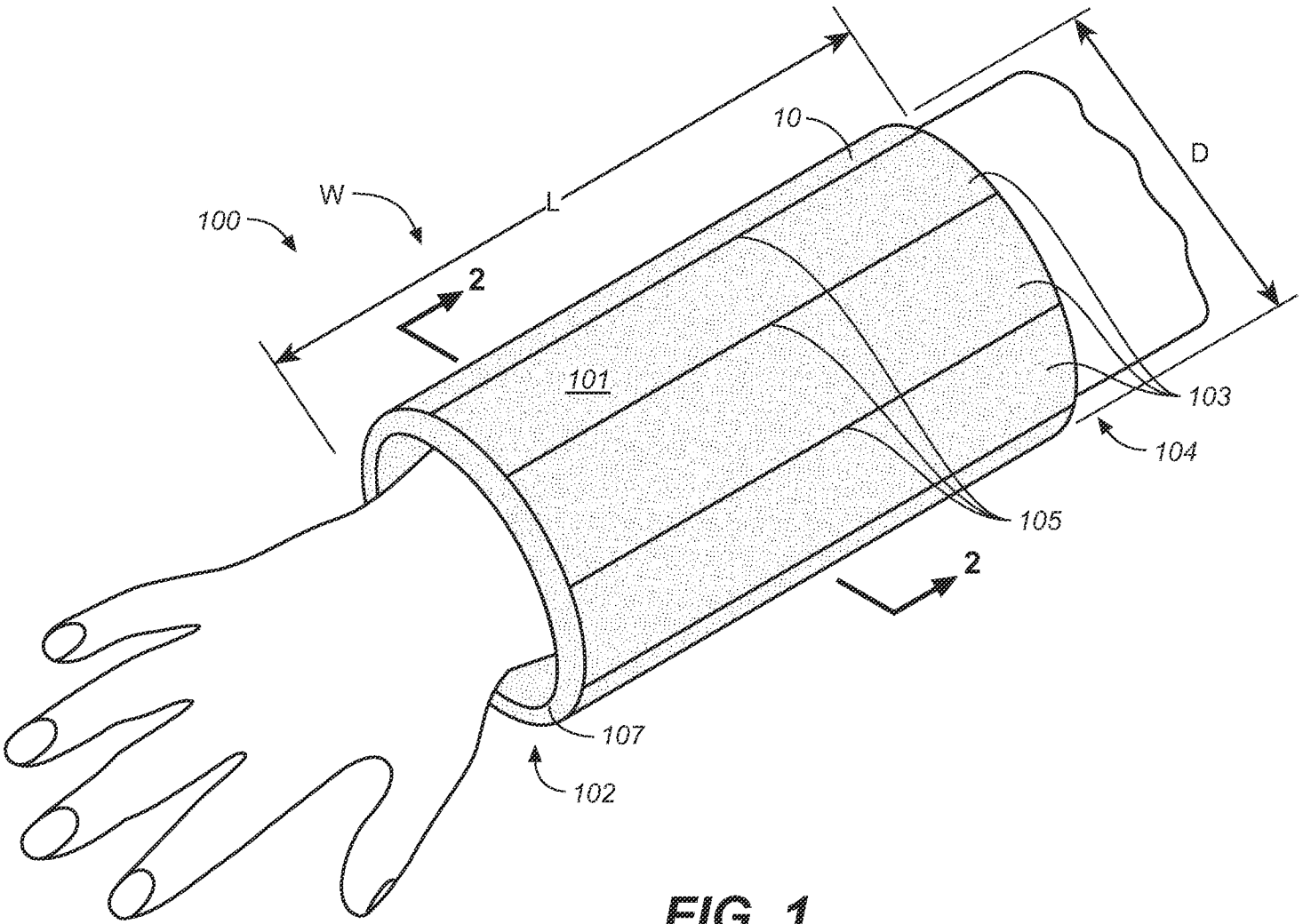
FIG. 1 is a perspective view of a wrist guard as worn on the wrist.

FIG. 1 is a perspective view of one embodiment of a device which may be used to provide support for a body part, and which may be, for example and without limitation, a wrist guard 100 which may provide support to a wrist W. Wrist guard 100 is formed from a material 10 into a generally cylindrical, or tubular, band having diameter D, and having an outer surface 101, a first open end 102, and a second open end 104. Open ends 102 and 104 form openings through wrist guard 100, separated by a length L, and permit the wrist guard to surround a body part, such as wrist W.

FIG. 1 further shows wrist guard 100 as including several longitudinal segments 103 which may be separated by dividers 105. The size and shape of each segment 103 may be approximately the same, or may be differently sized and shaped. Segments 103 may be fabric, or may be a combination of fabric and one or more stiffening elements, as described subsequently. In certain embodiment, one or more of segments 103 includes a pocket formed from material 10, where the pocket may be open or closed, and divider 105 includes stitching in material 10. The segments may provide reinforcement of wrist guard 100, as discussed subsequently.

In certain embodiments, the number of segments 103 is between 6 and 12. Thus, for example and without limitation, the number of segments is 6, 7, 8, 9, 10, 11, or 12. In yet other certain embodiments, the number of segments is greater than 4, greater than 5, greater than 6, greater than 7, greater than 8, greater than 9, greater than 10, greater than 11, or may be greater than 12.

In certain embodiments, material 10 is a fabric, which may be elastic, and which may include natural and/or synthetic fibers. Material 10 may be, for example and without limitation, be an elastic fabric, which may, for example, include fibers of cotton, NYLON™, and SPANDEX™, such as a combination of 80% Cotton, 10% NYLON™, and 10% SPANDEX™.

For use as a wrist guard, the length L is preferably from 2.5 to 6 inches, and may be sized for different portions of the population. L may, for example and without limitation, be 2.5 inches, 3 inches, 3.5 inches, 4 inches, 4.5 inches, 5 inches, or 5.5 inches, or 6 inches. Thus, for example, L may be from approximately 3 inches to approximately 4 inches for use by women or children, or approximately 5 inches for use by men. The diameter D is preferably from 2 to 4 inches, and may also be sized for different populations. Thus, for example, D may be from approximately 2.5 inches to approximately 3 inches for use by women or children, and approximately 3 inches to approximately 3.5 inches for use by men.

Figure 2:
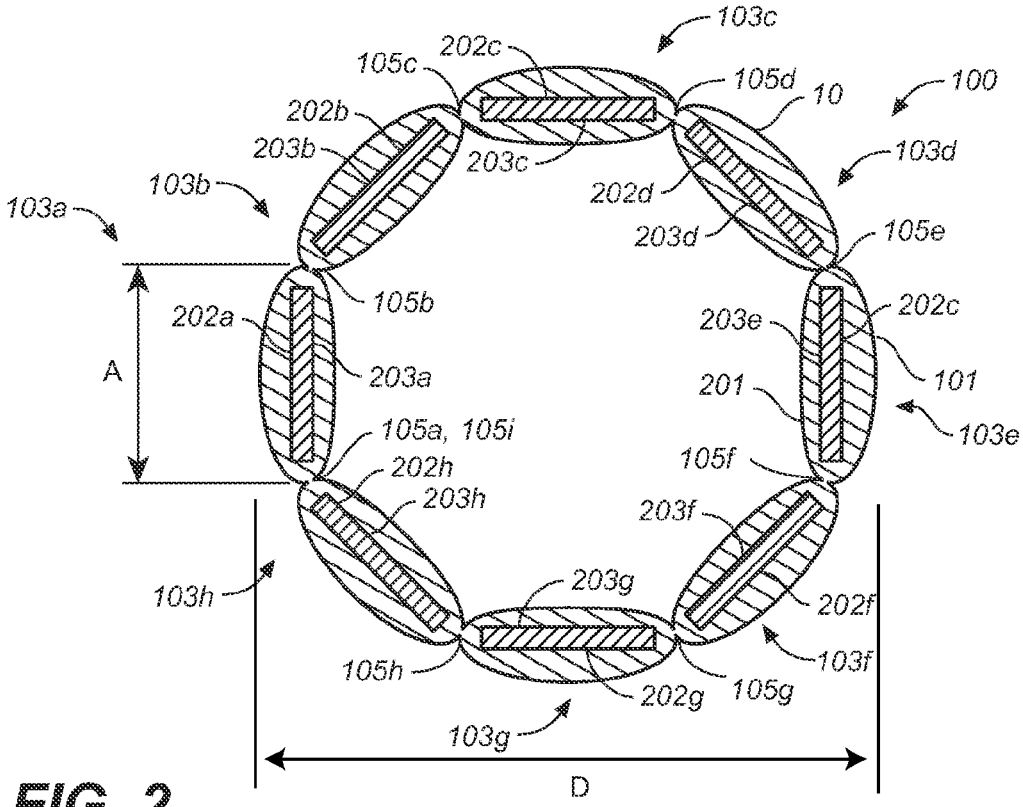
FIG. 2 is a sectional view 2-2 of a first embodiment wrist guard.

FIG. 2 is a sectional view 2-2 of a first embodiment wrist guard 100, which may be generally similar to the embodiment of FIG. 1, except as further detailed below. Where possible, similar elements are identified with identical reference numerals in the depiction of the embodiments of FIGS. 1 and 2.

Wrist guard 100 of FIG. 2 has eight equal sized segments 103 that each includes a pocket 202 having a length L and a width A. Thus segments 103*a*, 103*b*, 103*c*, 103*d*, 103*e*, 103*f*, 103*g*, and 103*h*, have corresponding pockets 202*a*, 202*b*, 202*c*, 202*d*, 202*e*, 202*f*, 202*g*, and 221*h*. The total width of all pockets 202, 8 A, is approximately the circumference of wrist guard 100, or π D. Each pocket 202 may be empty, or may contain one or more elements 203 to provide longitudinal reinforcement to the flexing of wrist guard 100. It is preferred, though not required, that the one or more elements 203 also have a length of approximately L and a width of approximately A.

Also shown in FIG. 2 is an inner surface 201. The reference to "inner surface 101" and "outer surface 201" is not meant to limit the use of wrist guard 100, since, in certain embodiments, wrist guard 100 is flexible, and the cylinder can be inverted so that either one of surface 101 or 201 may be an inner or outer surface.

In certain embodiments, one or more elements 203 is a sturdy and bendable material having rectangular dimensions, with a width B (see FIG. 3) of from approximately 0.5 inches to 1.5 inches, and may be, for example and without limitation, 0.5 inches, 0.75 inches, 1 inch, 1.25 inches, or 1.5 inches, and a length C (see FIG. 4) of from 2.5 to 6 inches, such as 2.5 inches, 3 inches, 3.5 inches, 4 inches, 4.5 inches, 5 inches, 5.5 inches, or 6 inches. Elements 203 may be formed from, or include layers of materials including, but not limited to: metals; plastics, which may include, for example and without limitation, a high-density polyethylene (HDPE), a foam which may include, for example and without limitation, a visco-elastic polyurethane or an ethylene vinyl acetate foam; or a rubber such as neoprene. Elements 203 may, for example and without limitation, have a thickness E (see FIG. 4A) be from 1/64 inch to 1/16 inch thick and may be, for example and without limitation, be 1/64 inch, 1/32 inch, 3/64 inch, or 1/16 inch thick. Thus, for example and without limitation, elements 203 may be HDPE plastic with E=1/32 inch, B=0.75 inch and C=4.75 inch.

In one embodiment, wrist guard 100 of FIG. 2 is formed from a single piece of material 10 having an approximate length 2 L and an approximate width 8 A. The material may be doubled over, for example, and dividers 105*a*, 105*b*, 105*c*, 105*d*, 105*e*, 105*f*, 105*g*, 105*h* and 105*i* may be provided as lengthwise stitching in material 10 to form pockets 202*a*, 202*b*, 202*c*, 202*d*, 202*e*, 202*f*, 202*g*, and 202*h*. Divider 105*i* may be sewn near divider 105*a* to form a cylindrical band. A circumferential stitch, which may be near and end, such as opening 107 may provided to form one or more closed pockets 202. Alternatively, a circumferential stitch may not be provided and the form one or more pockets that may be opened.

In various embodiments, one or more of pockets 202*a*, 202*b*, 202*c*, 202*d*, 202*e*, 202*f*, 202*g*, and 202*h* may contain one or more elements 203. FIG. 2 shows, for example and without limitation, element 203*a*, 203*b*, 203*c*, 203*d*, 203*e*, 203*f*, 203*g*, and 203*h*, within a separate pocket 202*a*, 202*b*, 202*c*, 202*d*, 202*e*, 202*f*, 202*g*, and 202*h*.

Figure 5:
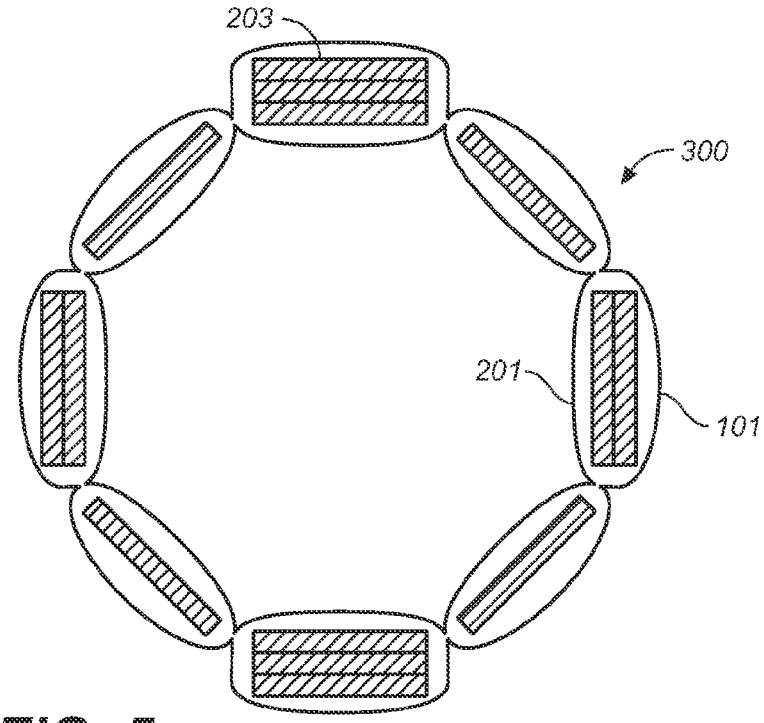
FIG. 5 is a sectional view 5-5 of FIG. 3.
Figure 3:
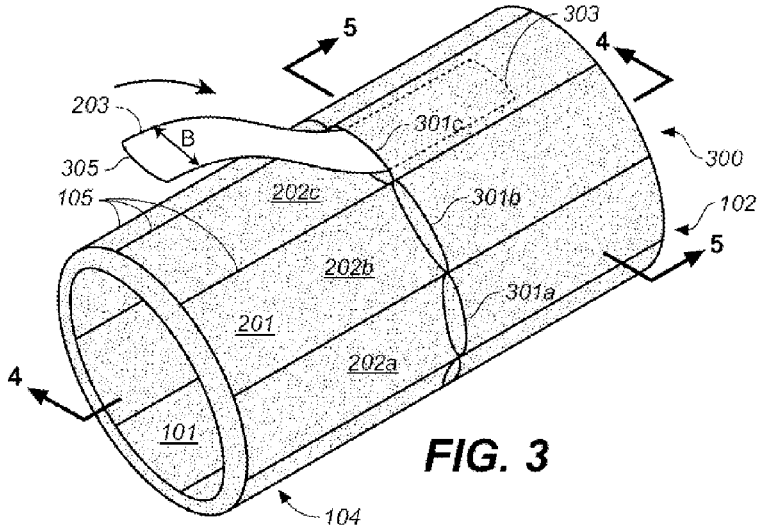
FIG. 3 is a perspective view of an inverted, second embodiment wrist guard.
Figure 4A:
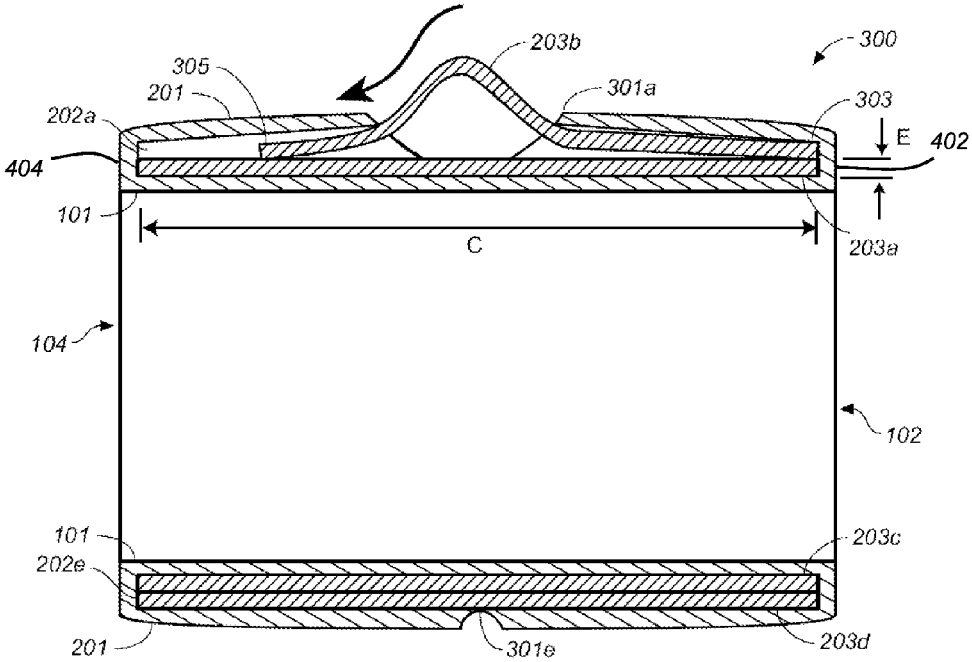
FIG. 4A is a sectional view 4-4 of FIG. 3.
Figure 4B:
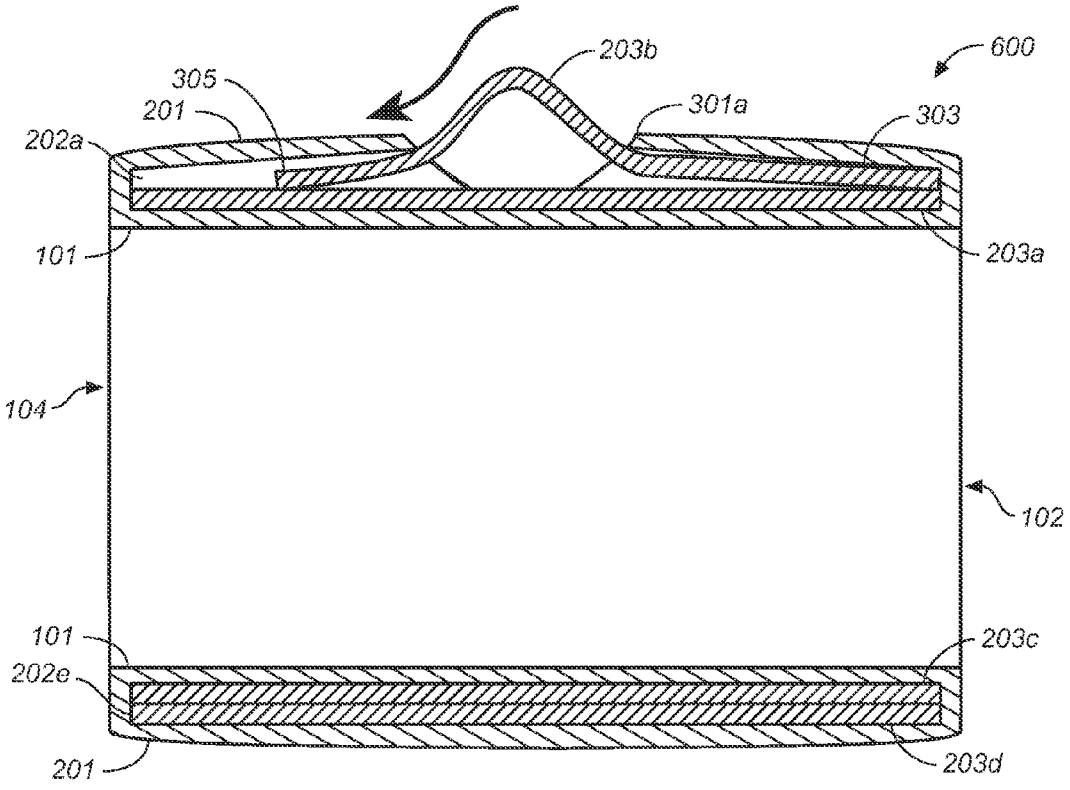
FIG. 4B is a sectional view 4-4 of a third embodiment wrist guard.

FIG. 3 is a perspective view of a second embodiment wrist guard 300, FIG. 4 is a sectional view 4-4 of FIG. 3, and FIG. 5 is a sectional view 5-5 of FIG. 3. Wrist guard 300 may be generally similar to wrist guard 100, except as further detailed below. Where possible, similar elements are identified with identical reference numerals in the depiction of the embodiments of FIGS. 1-5.

Wrist guard 300 as show in FIGS. 3-5 is inverted, with "inner surface" 101 facing outwards and "outer surface" 201 facing inwards. This configuration is useful for providing reinforcing elements to wrist guard 300, as discussed subsequently. Wrist guard 300 may be worn about wrist W in this configuration, or un-inverted as shown for wrist guard 100 in FIG. 1.

Wrist guard 300 is configurable, in that a user may modify the number and distribution of elements 203 within some or all pockets 202. Thus pockets 202*a*, 202*b*, 202*c*, 202*d*, and 202*e*, for example, have corresponding openings 301*a*, 301*b*, 301*c*, 301*d*, and 301*e* through which one or more elements 203 may be inserted or removed. FIGS. 3 and 4 illustrate providing an element 203 with a width B, a length C and a thickness F, and having ends 303 and 305, into pocket 202*a*. As discussed above, elements 203 may, for example, have a width B of from approximately 0.5 inches to 1.5 inches, a length C of from approximately 2.5 to 6 inches, and a thickness of from 1/64 inch to 1/16 inch.

A user may place end 303 into opening 301, as shown in FIG. 3, and then place end 305 into the opening. As shown in FIG. 4, pockets 202 may contain more than one element, such as two elements as illustrated by elements 203*a*, 203*b*, 203*c*, and 203*d*. This is further illustrated in FIG. 5, which shows the pockets having, for example and without limitation, one, two, or three elements.

Figure 6A:
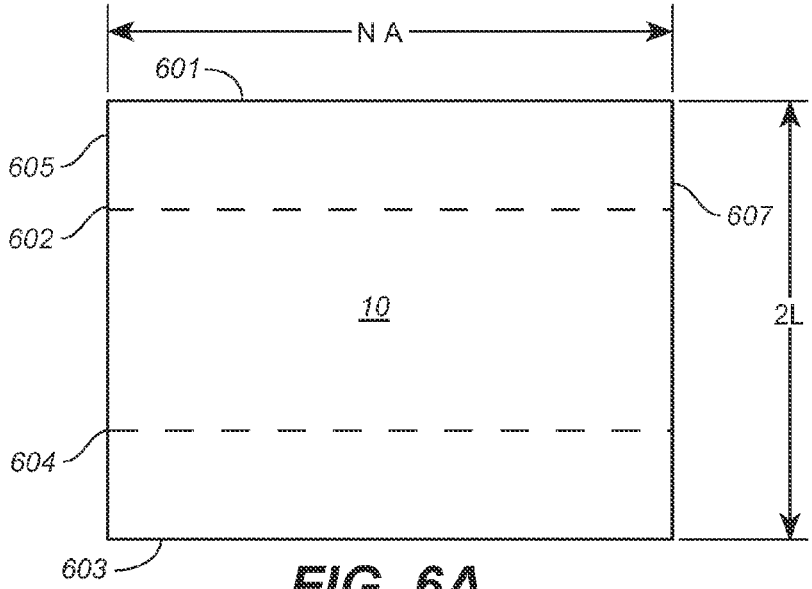
FIGS. 6A-6C illustrate a method of manufacturing the wrist guard.
Figure 6B:
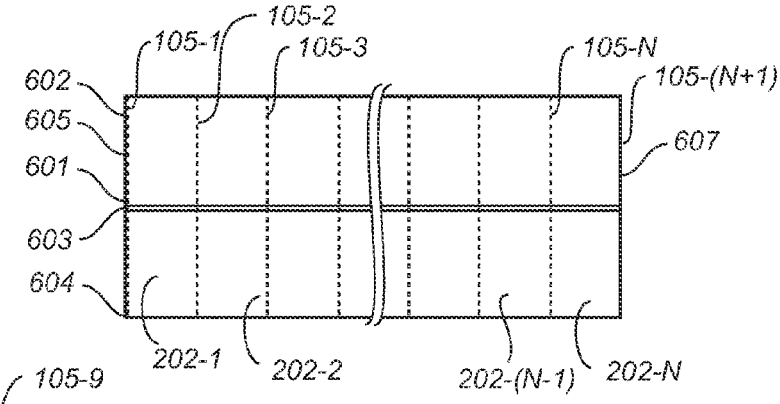
Figure 6C:
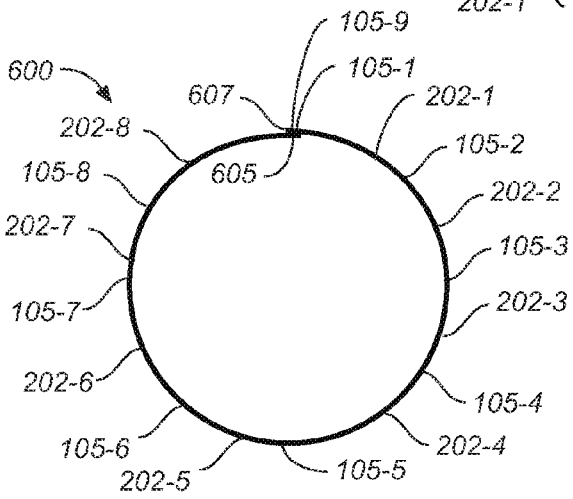

FIGS. 6A, 6B, and 6C illustrate one method of making wrist guard 600. Wrist guard 600 may be generally similar to wrist guard 100 or 300, except as further detailed below. As shown in FIG. 6A, a rectangular piece of material 10 has widthwise edges 601 and 603 and lengthwise edges 605 and 607 is used for constructing a wrist guard 600 having N pockets 202 (specifically, pockets 202-1, 202-2, . . . , 202-N). The width of material 10 is thus N times A, where A is the width of each pocket 202.

As shown in FIG. 6A, material 10 has parallel folds 602 and 604 (also shown in FIG. 4A, 402 and 404). In FIG. 6B, material 10 has been folded along folds 602 and 604, bringing edges 601 and 603 near each other, and a plurality of stitches 105 are sewn lengthwise. Thus, for example and without limitation, N pockets may be formed by N+1 stitches, as shown in FIG. 6B. The space between edges 601 and 603 provides openings 301 in the finished wrist guard 300. Alternatively, one or more elements 203 may be placed within a pocket, and a stitch may be provided between edges 601 and 603 to non-removably hold the one or more elements within the pocket.

In FIG. 6C, one embodiment having, for example and without limitation, N=8 pockets is shown. Material 10 is folded to bring edges 605 and 607 (that is, stitch 105-1 and 105-(N+1), which is 105-9) together, and an additional stitch is applied at or near stitches 105-1 and 105-(N+1) to form wrist guard 600.

Reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment. Furthermore, the particular features, structures or characteristics may be combined in any suitable manner, as would be apparent to one of ordinary skill in the art from this disclosure, in one or more embodiments.

Similarly, it should be appreciated that in the above description of exemplary embodiments of the invention, various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Rather, as the following claims reflect, inventive aspects lie in less than all features of a single foregoing disclosed embodiment. Thus, the claims following the Detailed Description are hereby expressly incorporated into this Detailed Description, with each claim standing on its own as a separate embodiment of this invention.

Thus, while there has been described what is believed to be the preferred embodiments of the invention, those skilled in the art will recognize that other and further modifications may be made thereto without departing from the spirit of the invention, and it is intended to claim all such changes and modifications as fall within the scope of the invention.

We claim:

1. A wrist guard comprising:

an open cylindrical tube formed from a single piece of fabric material, said tube comprising:

first and second opposing open ends of said tube to permit said tube to surround a body part, an inner surface and an outer surface between said first and second opposing open ends of said tube, wherein if said tube is inverted the inner surface becomes the outer surface, wherein said fabric material is continuous along an entire length of the inner surface between the first open end and the second opposing open end of said tube, and wherein said fabric material is folded over at the first open end and the second opposing open end to form the inner surface and the outer surface;

one or more pockets extending along the length of said tube from the first open end to the second opposing open end, wherein said pockets are formed between the inner surface and the outer surface, and wherein said pockets have opposing pocket ends formed by the folds of the fabric material, so that the opposing pocket ends are permanently closed, and wherein at least one of said one or more pockets has a pocket opening spaced from and positioned between the opposing pocket ends; and one or more inserts each designed to removably fit through said opening, where said one or more inserts are bendable, and where said one or more inserts have a length sufficient to substantially fill the associated pocket, such that the inserts provide longitudinal stiffness to said tube.

2. The wrist guard of claim 1, where at least one of said one or more pockets contains at least one of said one or more inserts.

3. The wrist guard of claim 1, where said one or more pockets is at least 6 pockets and no more than 8 pockets.

4. The wrist guard of claim 1, where said fabric is an elastic fabric.

5. The wrist guard of claim 1, where said tube has a length of 2.5 inches to 6 inches.

6. The wrist guard of claim 1, where one of said one or more inserts includes a bendable plastic or metal.

7. The wrist guard of claim 1, where one of said one or more inserts has a length of 2.5 inches to 6 inches.

8. The wrist guard of claim 1, where one of said one or more inserts has a width of 0.5 to 1.5 inches.

9. The wrist guard of claim 1, where one of said one or more pockets is designed to accept or contain two or more inserts.

10. A wrist guard comprising:

an open cylindrical tube formed from a single piece of elastic fabric material, said tube comprising:

first and second opposing open ends of said tube to permit said tube to surround a body part;

an inner surface and an outer surface between said first and second opposing ends of said tube, wherein if said tube is inverted the inner surface becomes the outer surface;

wherein said elastic fabric material is continuous along the entire length of the inner surface between the first open end and the second opposing open end of said tube, and wherein said elastic fabric material is folded over at the first open end and the second opposing open end to form the inner surface and the outer surface;

eight pockets extending along the length of said tube from the first open end to the second opposing open end;

wherein said pockets are formed between the inner surface and the outer surface, and wherein said pockets have opposing pocket ends formed by the folds of the fabric material so that the opposing pocket ends of at least one pocket of said eight pockets are permanently closed and said at least one pocket has a pocket opening spaced from and positioned between the opposing pocket ends; and one or more bendable inserts each designed to removably fit through said opening, such that the inserts provide longitudinal stiffness to said tube.

11. The wrist guard of claim 10, where at least one of said one or more pockets contains at least one of said one or more inserts.

12. The wrist guard of claim 10, where one of said one or more inserts has a length of 2.5 inches to 6 inches.

13. The wrist guard of claim 10, where one of said one or more inserts has a width of 0.5 to 1.5 inches.

14. The wrist guard of claim 10, where one of said one or more pockets is designed to accept or contain two or more inserts.

15. A wrist guard for accepting one or more inserts, said wrist guard comprising:

an open cylindrical tube formed from a single piece of fabric, said tube comprising:

first and second opposing open ends of said tube to permit said tube to surround a body part;

an inner surface and an outer surface between said first and second opposing open ends of said tube, wherein if said tube is inverted the inner surface becomes the outer surface, and wherein the fabric is continuous along an entire length of the inner surface between the first open end and said second opposing open end of said tube, and wherein the fabric is folded over at the first open end and the second opposing open end to form the inner surface and the outer surface; and one or more pockets extending along the length of said tube from the first open end to the second opposing open end, wherein said pockets are formed between the inner surface and the outer surface, and wherein said pockets have opposing pocket ends formed by the folds of the fabric so that the opposing pocket ends of at least one of said one or more pockets are permanently closed, and said at least one pocket has a pocket opening spaced from and positioned between the opposing pocket ends to removably accept at least one of the one or more inserts, such that the accepted inserts provide longitudinal stiffness to said tube.

16. The wrist guard of claim 15, where at least one of said one or more pockets contains at least one of said one or more inserts.

17. The wrist guard of claim 15, where said one or more pockets is at least 6 pockets and no more than 8 pockets.

18. The wrist guard of claim 15, where said fabric is an elastic fabric.

19. The wrist guard of claim 15, where said tube has a length of 2.5 inches to 6 inches.

20. The wrist guard of claim 15, where one of said one or more pockets has a length of 2.5 inches to 6 inches.

21. The wrist guard of claim 15, where one of said one or more pockets has a width of 0.5 to 1.5 inches.

22. The wrist guard of claim 15, where one of said one or more inserts includes a bendable plastic or metal.

23. The wrist guard of claim 15, where one of said one or more pockets is designed to accept or contain two or more inserts.

24. The wrist guard of claim 1, where said pocket opening is located about mid-way between the opposed ends of the pocket.

25. The wrist guard of claim 1 wherein the pockets are distributed circumferentially around the tube.

26. The wrist guard of claim 11, where said pocket opening is approximately midway between said first pocket end and said second pocket end.

* * * * *